US011376870B2

(12) United States Patent
Kaneko et al.

(10) Patent No.: US 11,376,870 B2
(45) Date of Patent: Jul. 5, 2022

(54) LIQUID EJECTING DEVICE HAVING RECESSES AND PROTRUSIONS ON CONTACT SURFACE BETWEEN TRANSPORT BELT AND ROLLERS OF LIQUID EJECTING DEVICE

(71) Applicant: SEIKO EPSON CORPORATION, Tokyo (JP)

(72) Inventors: Kenichiro Kaneko, Okaya (JP); Seijun Horie, Matsumoto (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/064,940

(22) Filed: Oct. 7, 2020

(65) Prior Publication Data

US 2021/0107298 A1 Apr. 15, 2021

(30) Foreign Application Priority Data

Oct. 9, 2019 (JP) ..... JP2019-186167

(51) Int. Cl.

| | |
|---|---|
| ***B41J 11/00*** | (2006.01) |
| ***B41J 15/04*** | (2006.01) |
| *B41J 13/08* | (2006.01) |
| *B41J 3/407* | (2006.01) |

(52) U.S. Cl.
CPC ..... *B41J 11/007* (2013.01); *B41J 15/048* (2013.01); *B41J 3/4078* (2013.01); *B41J 13/08* (2013.01)

(58) Field of Classification Search
CPC ..... B41J 11/007; B41J 15/048; B41J 13/08; B41J 3/4078
See application file for complete search history.

(56) References Cited

U.S. PATENT DOCUMENTS

2002/0018097 A1* 2/2002 Kitahara ..... B41J 11/0085 347/42

FOREIGN PATENT DOCUMENTS

JP 2018-058283 A 4/2018

* cited by examiner

*Primary Examiner* — Henok D Legesse
(74) *Attorney, Agent, or Firm* — Workman Nydegger

(57) ABSTRACT

Provided is a liquid ejecting device that includes an endless transporting belt that is stretched over a plurality of rollers and transports a medium in a transport direction by rotating while supporting the medium at a support surface that is a surface on an opposite side from a contact surface with the rollers, and a liquid ejecting unit that ejects a liquid onto the medium supported by the support surface. At the contact surface, recesses and protrusions are regularly formed in the circumferential direction of the transporting belt.

13 Claims, 5 Drawing Sheets

LIQUID EJECTING DEVICE HAVING RECESSES AND PROTRUSIONS ON CONTACT SURFACE BETWEEN TRANSPORT BELT AND ROLLERS OF LIQUID EJECTING DEVICE

The present application is based on, and claims priority from JP Application Serial Number 2019-186167, filed Oct. 9, 2019, the disclosure of which is hereby incorporated by reference herein in its entirety.

BACKGROUND

1. Technical Field

The present disclosure relates to a liquid ejecting device.

2. Related Art

In related art, a liquid ejecting device is used that ejects a liquid onto a medium while transporting the medium using an endless transporting belt stretched over a plurality of rollers. For example, JP-A-2018-58283 discloses a printing apparatus that ejects ink from an ejection head onto a printing medium while transporting the printing medium using an endless belt stretched over a belt-rotated roller and a belt-driving roller.

However, as in the printing apparatus disclosed in JP-A-2018-58283, in a liquid ejecting device of the related art that ejects a liquid onto a medium while transporting the medium using an endless transporting belt stretched over a plurality of rollers, for example, as a result of mist generated by the ejected liquid becoming attached to a side of the transporting belt that comes into contact with the rollers, a contact surface of the transporting belt with the rollers becomes wet in some cases. Further, in the related art, because the contact surface of the transporting belt with the rollers and a surface of each of the rollers that comes into contact with the contact surface are both smooth surfaces, if the contact surface becomes wet, the rollers may slip with respect to the transporting belt, and there is a risk that transport accuracy may deteriorate. Thus, an object of the present disclosure is to suppress a deterioration in transport accuracy caused by a transporting belt.

SUMMARY

A liquid ejecting device according to an aspect of the present disclosure for solving the problem described above includes an endless transporting belt stretched over a plurality of rollers and configured to transport a medium in a transport direction by rotating while supporting the medium at a support surface that is a surface on an opposite side from a contact surface with the rollers, and a liquid ejecting unit configured to eject a liquid onto the medium supported by the support surface. Recesses and protrusions are regularly formed at the contact surface in a circumferential direction of the transporting belt.

DESCRIPTION OF EXEMPLARY EMBODIMENTS

Figure 1:
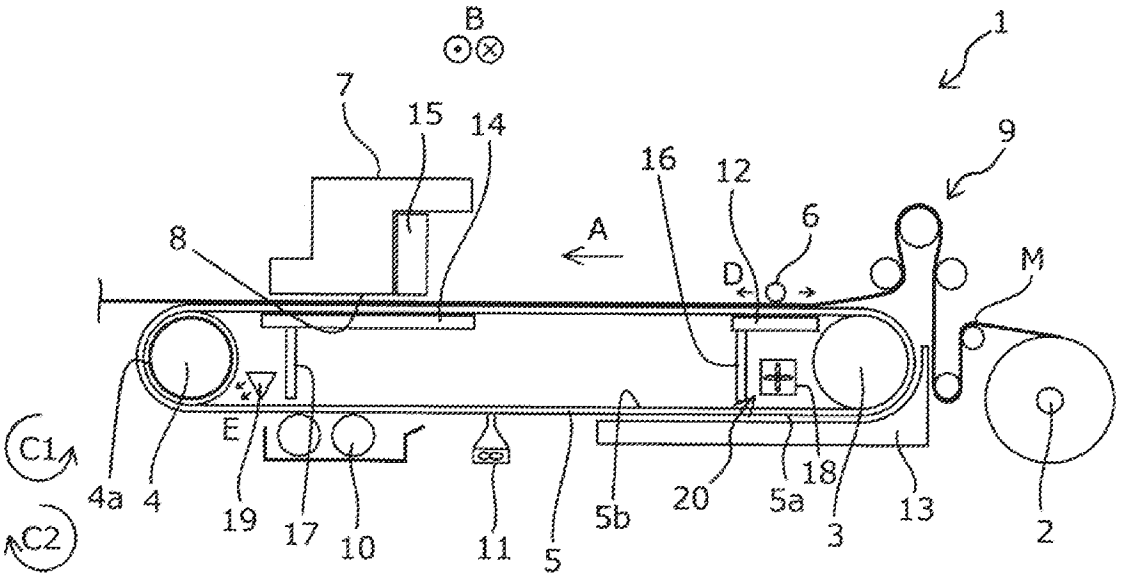
FIG. 1 is a schematic side view of a liquid ejecting device according to Example 1 of the present disclosure.

First, the present disclosure will be schematically described.

A liquid ejecting device according to a first aspect of the present disclosure for solving the problem described above includes an endless transporting belt stretched over a plurality of rollers and configured to transport a medium in a transport direction by rotating while supporting the medium at a support surface that is a surface on an opposite side from a contact surface with the rollers, and a liquid ejecting unit configured to eject a liquid onto the medium supported by the support surface. Recesses and protrusions are regularly formed at the contact surface in a circumferential direction of the transporting belt.

According to the present aspect, the recesses and protrusions are regularly formed at the contact surface of the transporting belt in the circumferential direction. Thus, even when a liquid attaches to the contact surface, the liquid can be caused to escape into recessed portions, and it is thus possible to inhibit the rollers from slipping with respect to the transporting belt and thereby suppress a deterioration in transport accuracy. Therefore, it is possible to suppress the deterioration in the transport accuracy caused by the transporting belt.

In the liquid ejecting device according to a second aspect of the present disclosure, with respect to the first aspect, the recesses and protrusions are formed at the contact surface entirely in the circumferential direction.

According to the present aspect, since the recesses and protrusions are formed at the contact surface entirely in the circumferential direction, even when the liquid becomes attached to any position at the contact surface, the liquid can be effectively caused to escape into the recessed portions, and it is thus possible to effectively inhibit the rollers from slipping with respect to the transporting belt and thereby suppress the deterioration in the transport accuracy.

In the liquid ejecting device according to a third aspect of the present disclosure, with respect to the first aspect, a recess/protrusion formation region, in which the recesses and protrusions are formed, and a recess/protrusion non-formation region, in which the recesses and protrusions are not formed, are alternately provided at the contact surface in the circumferential direction.

For stable rotation of the transporting belt, in some cases, it may be preferable to bring the recess/protrusion non-formation region, in which the recesses and protrusions are not formed, into contact with contacted surfaces of the rollers. However, according to the present aspect, even in such a case, since the recess/protrusion formation region and the recess/protrusion non-formation region are alternately provided, the stable rotation of the transporting belt and the suppression of the rollers from slipping with respect to the transporting belt can both be achieved.

In the liquid ejecting device according to a fourth aspect of the present disclosure, with respect to the liquid ejecting device according to any one of the first to third aspects, the recesses and protrusions include, as recessed portions, a plurality of first direction grooves extending along a first direction that intersects the circumferential direction and a width direction, of the transporting belt, intersecting the circumferential direction, and a plurality of second direction grooves extending along a second direction intersecting all of the circumferential direction, the width direction, and the first direction, and include, as protruding portions, each of regions surrounded by the first direction grooves and the second direction grooves forming the recessed portions.

According to the present aspect, even when a force is applied to the transporting belt in either a direction along the circumferential direction or a direction along the width direction, the force can be distributed by the plurality of grooves extending in the two directions intersecting the circumferential direction and the width direction. Thus, even when a force is unexpectedly applied to the transporting belt, the deterioration in the transport accuracy can be suppressed.

In the liquid ejecting device according to a fifth aspect of the present disclosure, with respect to the liquid ejecting device according to any one of the first to third aspects, the recesses and protrusions include, as protruding portions, a plurality of first direction ridge portions extending along a first direction that intersects the circumferential direction and a width direction, of the transporting belt, intersecting the circumferential direction, and a plurality of second direction ridge portions extending along a second direction intersecting all of the circumferential direction, the width direction, and the first direction, and include, as recessed portions, each of regions surrounded by the first direction ridge portions and the second direction ridge portions forming the protruding portions.

According to the present aspect, even when a force is applied to the transporting belt in either the direction along the circumferential direction or the direction along the width direction, the force can be distributed by the plurality of ridge portions extending in the two directions intersecting the circumferential direction and the width direction. Thus, even when a force is unexpectedly applied to the transporting belt, the deterioration in the transport accuracy can be suppressed.

In the liquid ejecting device according to a sixth aspect of the present disclosure, with respect to the liquid ejecting device according to any one of the first to third aspects, the recesses and protrusions include a plurality of convex-shaped protruding portions, and regions other than the protruding portions are formed as recessed portions.

According to the present aspect, the recesses and protrusions can be easily formed by emboss processing or the like.

In the liquid ejecting device according to a seventh aspect of the present disclosure, with respect to the liquid ejecting device according to any one of the first to third aspects, the recesses and protrusions include, as recessed portions, circumferential grooves extending along the circumferential direction, and include, as protruding portions, each of regions sandwiched between the circumferential grooves forming the recessed portions.

According to the present aspect, by forming the recessed portions by the circumferential grooves extending along the circumferential direction, a contact state of the contact surface with the rollers can be always kept constant, and it is thus possible to suppress the deterioration in the transport accuracy caused by variations in the contact state of the contact surface with the rollers.

A liquid ejecting device according to an eighth aspect of the present disclosure includes an endless transporting belt stretched over a plurality of rollers and configured to transport a medium in a transport direction by rotating while supporting the medium at a support surface that is a surface on an opposite side from a contact surface with the rollers, and a liquid ejecting unit configured to eject a liquid onto the medium supported by the support surface. Recesses and protrusions are regularly formed on contacted surfaces of the rollers that come into contact with the contact surface, in a circumferential direction of each of the rollers.

According to the present aspect, the recesses and protrusions are regularly formed at the contacted surfaces of the rollers in the circumferential direction. Thus, even when a liquid becomes attached to the contact surface, the liquid can be caused to escape into recessed portions formed in the contacted surfaces of the rollers, and it is thus possible to inhibit the rollers from slipping with respect to the transporting belt and thereby suppress the deterioration in the transport accuracy. Therefore, it is possible to suppress the deterioration in the transport accuracy caused by the transporting belt.

In the liquid ejecting device according to a ninth aspect of the present disclosure, with respect to the liquid ejecting device according to the eighth aspect, the recesses and protrusions are formed at the contacted surfaces entirely in the circumferential direction.

According to the present aspect, since the recesses and protrusions are formed at the contacted surfaces entirely in the circumferential direction, even when a liquid becomes attached to any position of the contact surface, the liquid can be effectively caused to escape into the recessed portions by bringing the liquid into contact with the recessed portions formed in the contacted surfaces, and it is thus possible to effectively inhibit the rollers from slipping with respect to the transporting belt and thereby suppress the deterioration in the transport accuracy.

In the liquid ejecting device according to a tenth aspect of the present disclosure, with respect to the liquid ejecting device according to the eighth aspect, a recess/protrusion formation region, in which the recesses and protrusions are formed, and a recess/protrusion non-formation region, in which the recesses and protrusions are not formed, are alternately provided at the contacted surfaces in the circumferential direction.

For stable rotation of the transporting belt, in some cases, it may be preferable to bring the recess/protrusion non-formation region, in which the recesses and protrusions are not formed, into contact with the contact surface of the transporting belt. However, according to the present aspect, even in such a case, since the recess/protrusion formation region and the recess/protrusion non-formation region are alternately provided, it is possible to achieve both the stable rotation of the transporting belt and the suppression of the rollers from slipping with respect to the transporting belt.

In the liquid ejecting device according to an eleventh aspect of the present disclosure, with respect to the liquid ejecting device according to any one of the eighth to tenth aspects, the recesses and protrusions include, as recessed portions, a plurality of first direction grooves extending along a first direction that intersects the circumferential direction and a width direction, of the transporting belt, intersecting the circumferential direction, and a plurality of second direction grooves extending along a second direction intersecting all of the circumferential direction, the width direction, and the first direction, and include, as protruding portions, each of regions surrounded by the first direction grooves and the second direction grooves forming the recessed portions.

According to the present aspect, even when a force is applied to the transporting belt in either a direction along the circumferential direction or a direction along the width direction, the force can be distributed by the plurality of grooves extending in two directions intersecting the circumferential direction and the width direction. Thus, even when a force is unexpectedly applied to the transporting belt, the deterioration in the transport accuracy can be suppressed.

In the liquid ejecting device according to a twelfth aspect of the present disclosure, with respect to the liquid ejecting device according to any one of the eighth to tenth aspects, the recesses and protrusions include, as protruding portions, a plurality of first direction ridge portions extending along a first direction that intersects the circumferential direction and a width direction, of the transporting belt, intersecting the circumferential direction, and a plurality of second direction ridge portions extending along a second direction intersecting all of the circumferential direction, the width direction, and the first direction, and include, as recessed portions, each of regions surrounded by the first direction ridge portions and the second direction ridge portions forming the protruding portions.

According to the present aspect, even when a force is applied to the transporting belt in either a direction along the circumferential direction or a direction along the width direction, the force can be distributed by the plurality of ridge portions extending in two directions intersecting the circumferential direction and the width direction. Thus, even when a force is unexpectedly applied to the transporting belt, the deterioration in the transport accuracy can be suppressed.

In the liquid ejecting device according to a thirteenth aspect of the present disclosure, with respect to the liquid ejecting device according to any one of the eighth to tenth aspects, the recesses and protrusions include a plurality of convex-shaped protruding portions, and regions other than the protruding portions are formed as recessed portions.

According to the present aspect, the recesses and protrusions can be easily formed by emboss processing or the like.

In the liquid ejecting device according to a fourteenth aspect of the present disclosure, with respect to the liquid ejecting device according to any one of the eighth to tenth aspects, the recesses and protrusions include, as recessed portions, circumferential grooves extending along the circumferential direction, and include, as protruding portions, each of regions sandwiched between the circumferential grooves forming the recessed portions.

According to the present aspect, by forming the recessed portions by the circumferential grooves extending along the circumferential direction, a contact state of the contacted surfaces with the transporting belt can be always kept constant, and it is thus possible to suppress the deterioration in the transport accuracy caused by variations in the contact state of the contacted surfaces with the transporting belt.

In the liquid ejecting device according to any one of the first to fourteenth aspects, the liquid ejecting device according to a fifteenth aspect of the present disclosure includes a drying unit configured to dry, from a side of the contact surface, the liquid attached to the contact surface.

According to the present aspect, since the liquid attached to the contact surface can be dried, the contact surface can be particularly effectively inhibited from becoming wet and slipping, and it is thus possible to particularly effectively suppress the deterioration in the transport accuracy caused by the transporting belt.

Example 1

Embodiments of the present disclosure will be described below with reference to the accompanying drawings. First, an overview of a liquid ejecting device 1 according to Example 1 of the present disclosure will be described with reference to FIG. 1.

As illustrated in FIG. 1, the liquid ejecting device 1 of the present example is provided with a transporting belt 5 that can transport a medium M in a transport direction A by rotating in a rotation direction C1. Further, the liquid ejecting device 1 is provided with a feeding unit 2 that can feed the medium M as a result of the roll-shaped medium M being set and rotating the medium M in the rotation direction C1. The transporting belt 5 is configured to be able to transport the medium M, which is fed out from the feeding unit 2, via a group of rollers 9 in the transport direction A. The transporting belt 5 is an endless belt stretched over a driven roller 3 located upstream in the transport direction A and a driving roller 4 located downstream in the transport direction A.

Here, the transporting belt 5 is an adhesive belt including a support surface 5*a*, which is an outer surface and to which an adhesive is applied. As illustrated in FIG. 1, the medium M is supported and transported by the transporting belt 5 in a state in which the medium M is adhered to the support surface 5*a* to which the adhesive is applied. A region over which the transporting belt 5 supports the medium M is an upper-side region stretched over the driven roller 3 and the driving roller 4. Further, the driving roller 4 is a roller that rotates using a driving force from a motor (not illustrated), and the driven roller 3 is a roller that rotates in response to the rotation of the transporting belt 5 when the driving roller 4 is rotated.

The medium M fed out from the group of rollers 9 to the transporting belt 5 is pressed by a pressing roller 6 and adhered to the support surface 5*a*. The pressing roller 6 extends in a width direction B intersecting the transport direction A, and is movable in a movement direction D along the transport direction A. Further, a platen 12 is provided below a movement range of the pressing roller 6 with the transporting belt 5 interposed therebetween, and a configuration is adopted in which the medium M can be reliably adhered to the support surface 5*a* by moving the pressing roller 6 in the movement direction D while pressing the pressing roller 6 toward the platen 12 with the medium M and the transporting belt 5 sandwiched between the pressing roller 6 and the platen 12. In other words, as a result of the pressing roller 6 pressing the medium M against the transporting belt 5 across the width direction B, the medium M is adhered to the transporting belt 5 in a state in which the occurrence of wrinkles and the like is suppressed.

Further, the liquid ejecting device 1 is provided with a carriage 7 that can reciprocate in the width direction B along a carriage shaft 15 extending in the width direction B, and a head 8 that serves as a liquid ejecting unit attached to the carriage 7. The head 8 ejects ink, which is a liquid, onto the medium M transported in the transport direction A. A platen 14 is provided in a region facing the head 8 with the transporting belt 5 interposed therebetween. By supporting the transporting belt 5 by the platen 14 in the region facing the head 8, it is possible to suppress a deterioration in image quality caused by displacement of landing positions of the ink ejected from the head 8 as a result of the transporting belt 5 vibrating in the region facing the head 8.

In this way, the liquid ejecting device 1 of the present example can print an image by ejecting the ink from the head 8 onto the medium M to be transported, while causing the carriage 7 to reciprocate in the width direction B intersecting the transport direction A. Since the liquid ejecting device 1 of the present example is provided with the carriage 7 having such a configuration, the liquid ejecting device 1 of the present example can form a desired image on the medium M by repeating the transport of the medium M in the transport direction A by a predetermined transport amount, and the ejection of the ink while moving the carriage 7 in the width direction B in a state in which the medium M is stopped.

Note that, although the liquid ejecting device 1 of the present example is a so-called serial printer that performs the printing by alternately repeating the transport of the medium M by the predetermined amount and the reciprocating movement of the carriage 7, the liquid ejecting device 1 of the present example may be a so-called line printer that performs continuous printing while continuously transporting the medium M, using a line head in which nozzles are arranged in a line shape along the width direction B of the medium M.

When the medium M, on which the image has been formed, is discharged from the liquid ejecting device 1 of the present example, the medium M is sent to a drying device that volatilizes the ink components ejected onto the medium M, and to a winding device that takes up the medium M on which the image has been formed, or the like, which are provided at a subsequent stage to the liquid ejecting device 1 of the present example.

Here, a printable material is preferably used as the medium M. The term "printable material" refers to a fabric, a garment, other clothing products, and the like on which the printing can be performed. Fabrics includes natural fibers such as cotton, silk and wool, chemical fibers such as nylon, or composite fibers of natural fibers and chemical fibers such as woven cloths, knit fabrics, and non-woven cloths. Further, garments and other clothing products include sewn products, such as a T-shirt, handkerchief, scarf, towel, handbag, fabric bag, and furniture-related products including a curtain, sheet, and bed cover, as well as fabric before and after cutting to serve as pieces of cloth before sewing.

Furthermore, in addition to the printable material described above, the medium M may be special paper for inkjet printing, such as plain paper, high-quality paper, or glossy paper. Further, other materials that can be used as the medium M include, for example, a plastic film on which a surface treatment for inkjet printing is not performed, namely, a plastic film on which an ink absorption layer is not formed, and a material formed by applying plastic coating or bonding a plastic film on a paper substrate or the like. Such plastic materials include, but are not limited to, for example, polyvinyl chloride, polyethylene terephthalate, polycarbonate, polystyrene, polyurethane, polyethylene, and polypropylene.

When the printable material is used as the medium M, because strike-through of the ink easily occurs, which is a phenomenon in which the ink ejected onto the medium M seeps through to a back surface of the medium M, the transporting belt 5 may be stained by the ink in some cases. Thus, the liquid ejecting device 1 of the present example is provided with a cleaning unit 10 for cleaning the ink that has struck through and attached to the support surface 5*a* of the transporting belt 5. The cleaning unit 10 is provided with a cleaning brush that is immersed in a cleaning liquid and comes into contact with the support surface 5*a*. Further, the liquid ejecting device 1 of the present example is provided with an air blowing unit 11 that, by blowing air, removes the cleaning liquid attached to the support surface 5*a* as a result of the cleaning brush coming into contact with the support surface 5*a*. Furthermore, the liquid ejecting device 1 of the present example is provided with a support surface heating unit 13 that can heat and dry the cleaning liquid that cannot be completely removed by the air blowing unit 11.

The liquid ejecting device 1 of the present example can transport the medium M in the transport direction A by rotating the driving roller 4 in the rotation direction C1. Further, the liquid ejecting device 1 of the present example can transport the medium M in a direction opposite to the transport direction A by rotating the driving roller 4 in a rotation direction C2, which is a direction opposite to the rotation direction C1.

Note that, as in the liquid ejecting device 1 of the present example, in a configuration in which the liquid is ejected from the liquid ejecting unit toward the medium M, the liquid that has not landed on the medium M or mist generated as a result of the liquid being ejected may float and attach to a contact surface 5*b*, which is a surface on the opposite side from the support surface 5*a* of the transporting belt 5 and comes into contact with the driven roller 3 and the driving roller 4. In this way, when the liquid attaches to the contact surface 5*b*, the transporting belt 5 may slip with respect to the driven roller 3 and the driving roller 4, and there is a risk that transport accuracy may deteriorate. Thus, the liquid ejecting device 1 of the present example is provided with a drying unit that dries the liquid attached to the contact surface 5*b*. The drying unit will be described in detail below.

Next, the transporting belt 5, the driven roller 3, and the driven roller 4, which are main components of the liquid ejecting device 1 of the present example, will be described below in detail with reference to FIG. 2 and FIG. 3. Note that although FIG. 3 illustrates the driving roller 4, a contacted surface 4*b* that is a surface of the driving roller 4 has the same configuration as a contacted surface that is a surface of the driven roller 3, and the following description of the contacted surface 4*b* of the driving roller 4 corresponds directly with a description of the contacted surface of the driven roller 3. Note that both the contacted surface 4*b* of the driving roller 4 and the contacted surface of the driven roller 3 are surfaces that come into contact with the contact surface 5*b* of the transporting belt 5.

Figure 2:
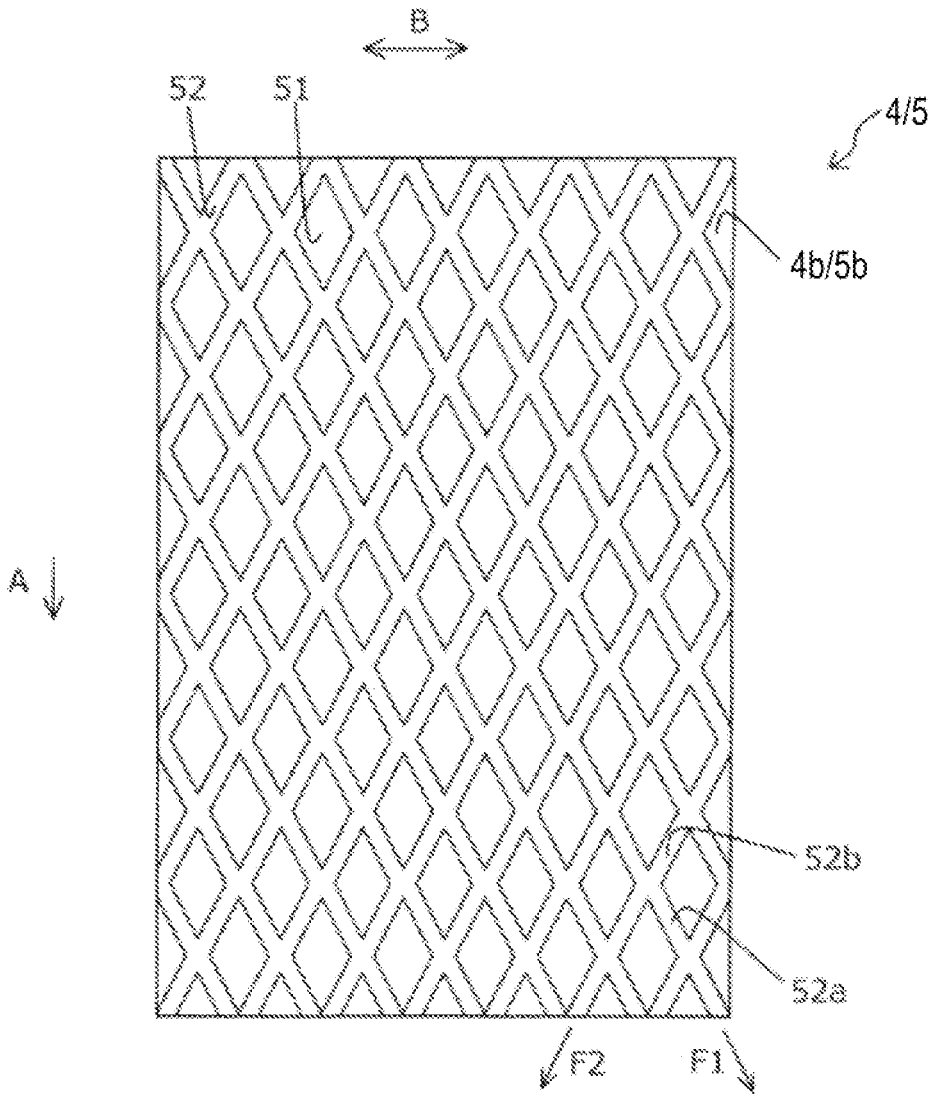
FIG. 2 is a schematic plan view illustrating a contact surface of a transporting belt of the liquid ejecting device illustrated in FIG. 1.
Figure 3:
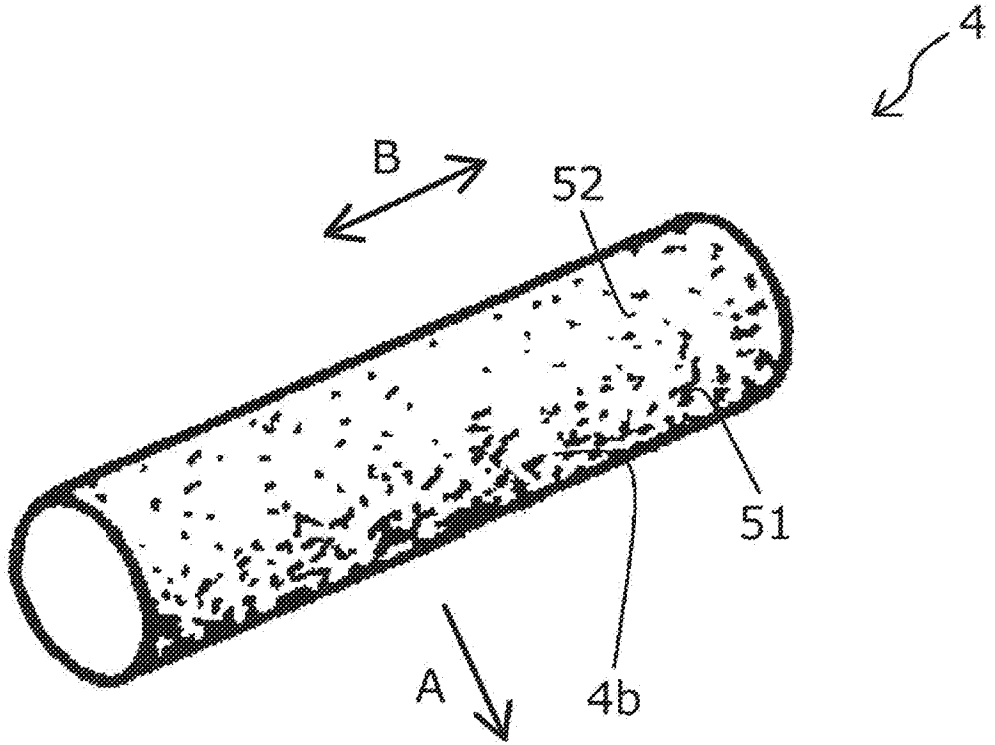
FIG. 3 is a schematic perspective view of a driving roller of the liquid ejecting device illustrated in FIG. 1.

As illustrated in FIG. 2, over the entire region of the contact surface 5*b* of the transporting belt 5 of the present example, a plurality of diamond-shaped protruding portions 51 and recessed portions 52 surrounding the protruding portions 51 are uniformly formed. In other words, a plurality of the groove-shaped recessed portions 52 extending in two directions intersecting the circumferential direction of the transporting belt 5 along the transport direction A and the width direction B, and the plurality of diamond-shaped protruding portions 51 surrounded by the recessed portions 52 are formed uniformly over the entire region of the contact surface 5*b*.

As described above, the liquid ejecting device 1 of the present example is provided with the endless transporting belt 5, which is stretched over the driven roller 3 and the driving roller 4 serving as the plurality of rollers, and which transports the medium M in the transport direction A by rotating the medium M in the rotation direction C1 while supporting the medium M on the support surface 5*a* that is the surface on the opposite side from the contact surface 5*b* that comes into contact with the driven roller 3 and the driving roller 4, and with the head 8, which ejects the ink onto the medium M supported by the support surface 5*a*. Further, as illustrated in FIG. 2, recesses and protrusions are regularly formed at the contact surface 5*b* of the transporting belt 5 of the present example in the circumferential direction of the transporting belt 5. Thus, in the liquid ejecting device 1 of the present example, even when a liquid such as the ink becomes attached to the contact surface 5*b*, the liquid can be caused to escape into the recessed portions 52, and it is thus possible to inhibit the driven roller 3 and the driving roller 4 from slipping with respect to the transporting belt 5 and thereby suppress the deterioration in the transport accuracy. Therefore, the liquid ejecting device 1 of the present example is configured to be able to suppress the deterioration in the transport accuracy caused by the transporting belt 5. Further, by suppressing the driven roller 3 and the driving roller 4 from slipping with respect to the transporting belt 5, meandering of the transporting belt 5 can also be suppressed without providing a meandering suppression mechanism or the like for the transporting belt 5. Thus, the liquid ejecting device 1 of the present example is simplified. Note that the liquid ejecting device 1 of the present example can suppress the deterioration in the transport accuracy caused by the liquid such as the ink attaching to the transporting belt 5, as described above, but further, with the above-described configuration, it is also possible to suppress the deterioration in the transport accuracy caused by foreign matter other than the liquid, such as dust or small pieces of the medium M, attaching to the transporting belt 5.

Note that the recesses and protrusions are formed at the contact surface 5*b* of the transporting belt 5 of the present example, entirely in the circumferential direction of the transporting belt 5. Thus, in the liquid ejecting device 1 of the present example, even when a liquid becomes attached to any position of the contact surface 5*b*, the liquid can be effectively caused to escape into the recessed portions 52, and it is thus possible to effectively inhibit the driven roller 3 and the driving roller 4 from slipping with respect to the transporting belt 5 and thereby suppress the deterioration in the transport accuracy.

Further, as described above, the recesses and protrusions of the contact surface 5*b* are configured by the plurality of diamond-shaped protruding portions 51 and the recessed portions 52 surrounding the protruding portions 51. In other words, as the recesses and protrusions, a plurality of first direction grooves 52*a* extending along a first direction F1 intersecting the circumferential direction of the transporting belt 5 and the width direction B, and a plurality of second direction grooves 52*b* extending along a second direction F2 intersecting all of the circumferential direction of the transporting belt 5, the width direction B, and the first direction F1 are provided so as to serve as the recessed portions 52, and each of regions surrounded by the first direction grooves 52*a* and the second direction grooves 52*b*, which form the recessed portions 52, is provided so as to serve as the protruding portion 51. In the liquid ejecting device 1 of the present example, when a force is applied to the transporting belt 5 in either a direction along the circumferential direction of the transporting belt 5 or a direction along the width direction B, the force can be distributed by the plurality of grooves extending in the two directions intersecting the circumferential direction of the transporting belt 5 and the width direction B. Thus, in the liquid ejecting device 1 of the present example, even when a force is unexpectedly applied to the transporting belt 5, the deterioration in the transport accuracy can be suppressed. However, the shapes of the recesses and protrusions of the contact surface 5*b* are not limited to the shapes as described in the present example.

For example, in contrast to the configuration of the liquid ejecting device 1 of the present example, the recesses and protrusions of the contact surface 5*b* may be configured by a plurality of diamond-shaped recessed portions and protruding portions surrounding the recessed portions. In other words, as the recesses and protrusions, the protruding portions may be formed by a plurality of first direction ridge portions extending along the first direction F1 intersecting the circumferential direction of the transporting belt 5 and the width direction B and a plurality of second direction ridge portions extending along the second direction F2 intersecting all of the circumferential direction of the transporting belt 5, the width direction B, and the second direction F2, and the recessed portions may be formed by each of regions surrounded by the first direction ridge portions and the second direction ridge portions that form the protruding portions. With this configuration, even when a force is applied to the transporting belt 5 in either the direction along the circumferential direction of the transporting belt 5 or the direction along the width direction B, the force can be distributed by the recessed portions surrounded by the plurality of ridge portions extending in the two directions intersecting the circumferential direction of the transporting belt 5 and the width direction B, and further, even when a force is unexpectedly applied to the transporting belt 5, the deterioration in the transport accuracy can be suppressed. Note that the "ridge portion" in the present specification refers to a protruding portion continuously formed in a linear shape.

Further, as illustrated in FIG. 3, emboss processing is performed on the contacted surface 4*b* of the driving roller 4 of the present example, and recesses and protrusions are uniformly formed over the entire region of the contacted surface 4*b*. Note that, although not illustrated, the same emboss processing as for the contacted surface 4*b* of the driving roller 4 is also performed on the contacted surface of the driven roller 3, and recesses and protrusions are also formed uniformly over the entire region of the contacted surface.

In other words, in the liquid ejecting device 1 of the present example, the recesses and protrusions are regularly formed on the contacted surface 4*b* of the driving roller 4 and the contacted surface of the driven roller 3 that come into contact with the contact surface 5*b*, in the circumferential direction of each of the driven roller 3 and the driving roller 4. Thus, in the liquid ejecting device 1 of the present example, even when a liquid such as the ink becomes attached to the contact surface 5*b* of the transporting belt 5, the liquid can be caused to escape into the recessed portions 52 formed in the contacted surfaces of the driven roller 3 and the driving roller 4, and it is thus possible to inhibit the driven roller 3 and the driving roller 4 from slipping with respect to the transporting belt 5 and thereby suppress the deterioration in the transport accuracy. Therefore, the liquid ejecting device 1 of the present example is configured to be able to suppress the deterioration in the transport accuracy caused by the transporting belt 5.

Note that the recesses and protrusions are formed on the contacted surface of the driven roller 3 and the contacted surface 4*b* of the driving roller 4 of the present example, entirely in the circumferential direction of each of the driven roller 3 and the driving roller 4. Thus, in the liquid ejecting device 1 of the present example, even when the liquid becomes attached to any position of the contact surface 5*b*, the liquid can be effectively caused to escape into the recessed portions 52 by bringing the liquid into contact with the recessed portions 52 of the contacted surface of the driven roller 3 and the contacted surface 4*b* of the driving roller 4, and it is thus possible to effectively inhibit the driven roller 3 and the driving roller 4 from slipping with respect to the transporting belt 5 and thereby suppress the deterioration in the transport accuracy.

Here, the recesses and protrusions formed on the contacted surface of the driven roller 3 and the contacted surface 4*b* of the driving roller 4 are configured by the emboss processing, and include the plurality of convex-shaped protruding portions 51 while regions other than the protruding portions 51 are formed as the recessed portions 52. By configuring the liquid ejecting device 1 of the present example in such a manner, the recesses and protrusions are easily formed. Note that the "convex-shaped protruding portion" also includes a ridge-like shape, that is, the shape of the protruding portion formed continuously in the linear shape.

Note that, in a similar manner to the recesses and protrusions formed on the contacted surface of the driven roller 3 and the contacted surface 4*b* of the driving roller 4, the recesses and protrusions formed at the contact surface 5*b* of the transporting belt 5 may be formed by the plurality of convex-shaped protruding portions 51 and the recessed portions 52, which are formed in the regions in which the protruding portions 51 are not formed. This is because the recesses and protrusions can be easily formed by the emboss processing or the like.

Conversely, in a similar manner to the recesses and protrusions formed at the contact surface 5*b* of the transporting belt 5, the recesses and protrusions formed on the contacted surface of the driven roller 3 and the contacted surface 4*b* of the driving roller 4 may be formed by the plurality of first direction grooves extending along the first direction F1 intersecting the circumferential direction of each of the driven roller 3 and the driving roller 4 and the width direction B, and the plurality of second direction grooves extending along the second direction F2 intersecting all of the circumferential direction, the width direction B, and the first direction, which serve as the recessed portions 52, and by each of the regions serving as the protruding portions 51, which are surrounded by the first direction grooves and the second direction grooves that form the recessed portions 52. With this configuration, even when a force is applied to the transporting belt 5 in either the direction along the circumferential direction or the direction along the width direction B, the force can be distributed by the plurality of grooves extending in the two directions intersecting the circumferential direction and the width direction B, and further, even when a force is unexpectedly applied to the transporting belt 5, the deterioration in the transport accuracy can be suppressed.

Furthermore, the recesses and protrusions formed on the contacted surface of the driven roller 3 and the contacted surface 4*b* of the driving roller 4 may be formed by the protruding portions that are formed by the plurality of first direction ridge portions extending along the first direction F1 intersecting the circumferential direction of each of the driven roller 3 and the driving roller 4 and the width direction B, and the plurality of second direction ridge portions extending along the second direction F2 intersecting all of the circumferential direction, the width direction B, and the first direction, and by the recessed portions formed by each of the regions surrounded by the first direction ridge portions and the second direction ridge portions forming the protruding portions. With this configuration, even when a force is applied to the transporting belt 5 in either the direction along the circumferential direction or the direction along the width direction B, the force can be distributed by the plurality of ridge portions extending in the two directions intersecting the circumferential direction and the width direction B, and further, even when a force is unexpectedly applied to the transporting belt 5, the deterioration in the transport accuracy can be suppressed.

Further, as described above, the liquid ejecting device 1 of the present example is provided with the drying unit. Specifically, the liquid ejecting device 1 of the present example includes three types of the drying unit to be described below. However, as the drying unit, at least one of the three types of the drying unit to be described below, or a drying unit having a different configuration from those of the three types to be described below may be provided in the liquid ejecting device 1 of the present example, as long as the drying unit is provided at the contact surface 5*b* side and can dry a liquid attached to the contact surface 5*b*. Furthermore, a configuration may be adopted in which the drying unit is not provided.

As illustrated in FIG. 1, the driving roller 4 of the present example is a heat roller that serves as a drying unit provided with an electrically heated wire 4*a*. More specifically, the driving roller 4 includes the electrically heated wire 4*a*, and is configured to be able to dry a liquid attached to the contact surface 5*b*, by heating the contact surface 5*b* that comes into contact with the driving roller 4. Although constituent materials and the like of the transporting belt 5 are not particularly limited, as the transporting belt 5 of the present example, an endless belt is adopted that includes an aramid core wire having a small thermal expansion coefficient even when it is heated.

Further, the liquid ejecting device 1 of the present example includes an infrared heater 19 as the drying unit. As illustrated in FIG. 1, the infrared heater 19 of the present example is provided at a position closer to the driving roller 4 than to the driven roller 3, and is configured to be able to dry the liquid attached to the contact surface 5*b* by irradiating infrared rays toward the contact surface 5*b* in an irradiation direction E, and heating the contact surface 5*b*.

Further, the liquid ejecting device 1 of the present example is provided with an air blowing unit 20 as the drying unit. As illustrated in FIG. 1, the air blowing unit 20 of the present example is provided at a position closer to the driven roller 3 than to the driving roller 4. The air blowing unit 20 is provided with a fan 18 and is configured to be able to dry the liquid attached to the contact surface 5*b* by blowing air from the fan 18 toward the contact surface 5*b*.

Note that a flat plate 16 extending in the width direction B is attached to the platen 12, and a flat plate 17 extending in the width direction B is attached to the platen 14. By partitioning a drying region by the air blowing unit 20 and a drying region by the driving roller 4 and the infrared heater 19 in this manner, high drying efficiency is achieved.

As described above, the liquid ejecting device 1 of the present example is provided with the drying units that dry, from the contact surface 5*b* side, the liquid such as the ink attached to the contact surface 5*b*. Thus, the liquid ejecting device 1 of the present example is configured to be able to dry the liquid attached to the contact surface 5*b*, particularly effectively inhibit the contact surface 5*b* from getting wet and slipping, and thereby particularly effectively suppress the deterioration in the transport accuracy caused by the transporting belt 5. Further, by drying and removing the liquid accumulated in the recessed portions 52, the effect of the recesses and protrusions can be maintained for a long period of time.

Example 2

Next, the liquid ejecting device 1 of Example 2 will be described below with reference to FIG. 4. Note that in FIG.

4, structural members common to those of Example 1 described above are denoted by the same reference signs, and a detailed description thereof is omitted. Here, the liquid ejecting device 1 of the present example has the same shape as the liquid ejecting device 1 of Example 1, except for the configuration of the transporting belt 5.

Figure 4:
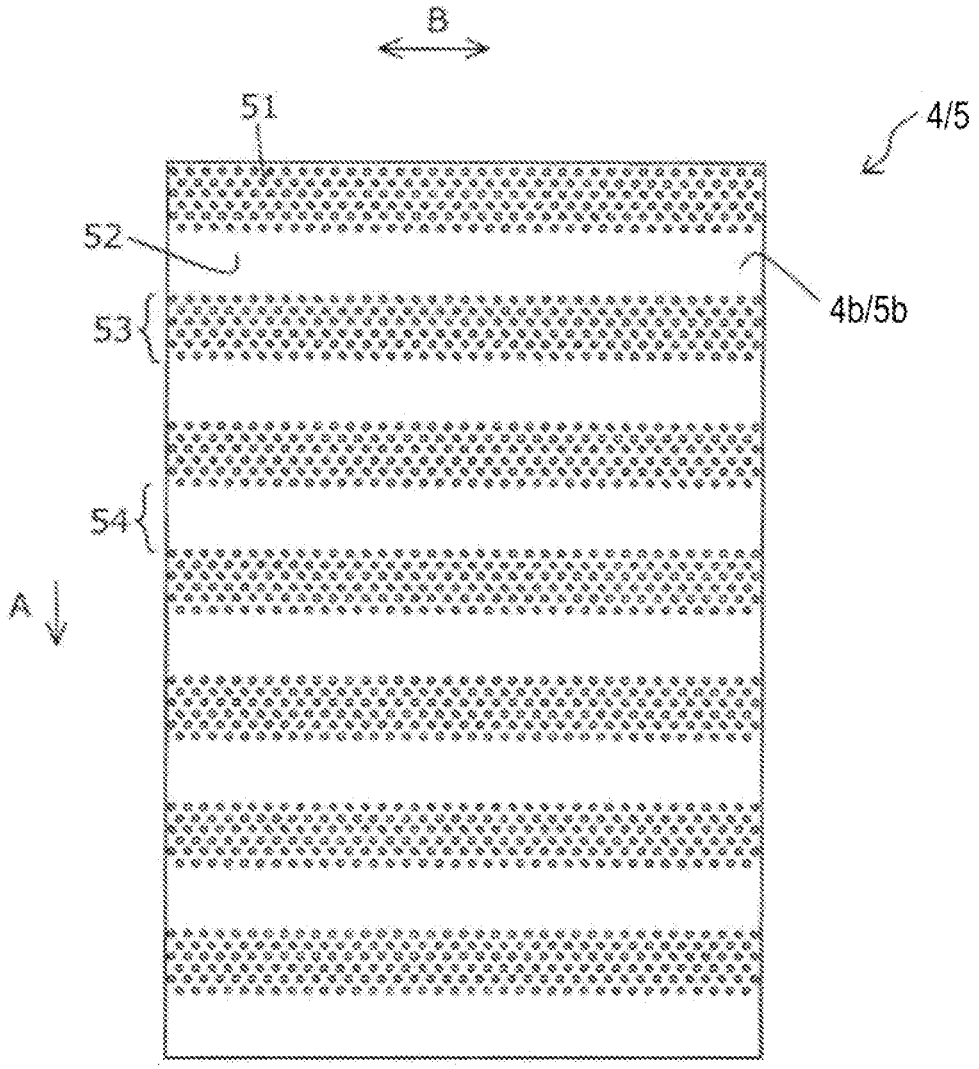
FIG. 4 is a schematic plan view illustrating a contact surface of a transporting belt of a liquid ejecting device according to Example 2 of the present disclosure.

As illustrated in FIG. 4, in the transporting belt 5 of the present example, a recess/protrusion formation region 53, which includes the plurality of convex-shaped protruding portions 51 and the recessed portions 52 formed as the region in which the protruding portions 51 are not formed, and a recess/protrusion non-formation region 54, which is formed only by the recessed portion 52 without including the protruding portions 51, are alternately formed in the circumferential direction of the transporting belt 5 along the transport direction A. In other words, the recesses and protrusions are also regularly formed on the transporting belt 5 of the present example, in the circumferential direction of the transporting belt 5. Note that the transporting belt 5 of the present example is configured such that at least one of the recess/protrusion formation regions 53 and at least one of the recess/protrusion non-formation regions 54 come into contact with the driven roller 3 and the driving roller 4, regardless of where the transporting belt 5 is disposed in the circumferential direction of the transporting belt 5.

In this way, at the contact surface 5*b* of the transporting belt 5 of the present example, the recess/protrusion formation region 53, in which the recesses and protrusions are formed, and the recess/protrusion non-formation region 54, in which the recesses and protrusions are not formed, are alternately formed in the circumferential direction of the transporting belt 5. For stable rotation of the transporting belt 5, in some cases, it may be preferable to bring the recess/protrusion non-formation regions 54, in which the recesses and protrusions are not formed, into contact with the contacted surface of the driven roller 3 and the contacted surface 4*b* of the driving roller 4. However, even in such a case, since the recess/protrusion formation regions 53 and the recess/protrusion non-formation regions 54 are alternately provided on the transporting belt 5 of the present example, it is possible to achieve both the stable rotation of the transporting belt 5 and the suppression of the driven roller 3 and the driving roller 4 from slipping with respect to the transporting belt 5.

Note that, in a similar manner to the recesses and protrusions formed at the contact surface 5*b* of the transporting belt 5, the recesses and protrusions formed on the contacted surface of the driven roller 3 and the contacted surface 4*b* of the driving roller 4 may have a configuration in which the recess/protrusion formation regions 53 and the recess/protrusion non-formation regions 54 are alternately provided in the circumferential direction of each of the driven roller 3 and the driving roller 4. This is because, where it is preferable to bring the recess/protrusion non-formation regions 54, in which the recesses and protrusions are not formed, into contact with the contact surface 5*b* of the transporting belt 5, it is possible to achieve both the stable rotation of the transporting belt 5 and the suppression of the driven roller 3 and driving roller 4 from slipping with respect to the transporting belt 5.

Example 3

Next, the liquid ejecting device 1 of Example 3 will be described below with reference to FIG. 5. Note that, in FIG. 5, structural members common to those of Example 1 and Example 2 described above are denoted by the same reference signs, and a detailed description thereof is omitted. Here, the liquid ejecting device 1 of the present example has the same shape as the liquid ejecting devices 1 of Example 1 and Example 2, except for the configuration of the transporting belt 5.

Figure 5:
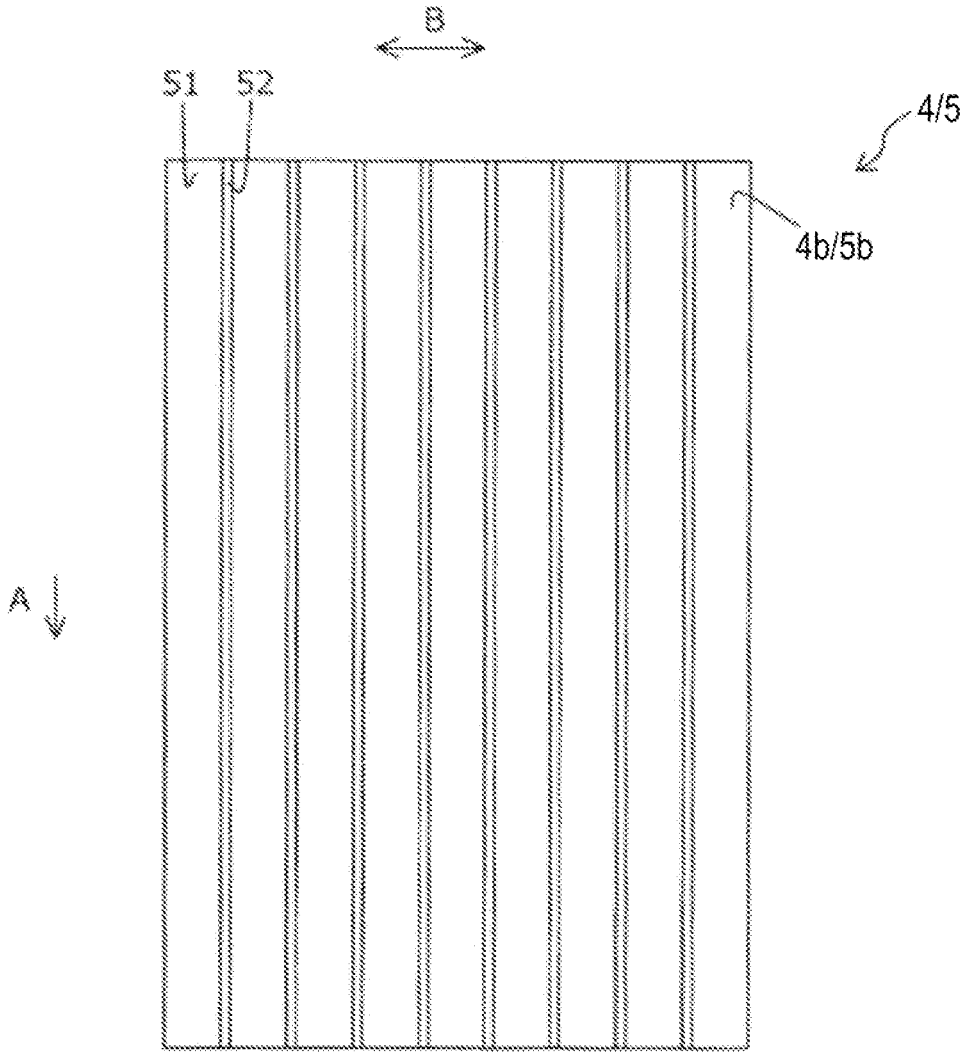
FIG. 5 is a schematic plan view illustrating a contact surface of a transporting belt of a liquid ejecting device according to Example 3 of the present disclosure.

As illustrated in FIG. 5, the transporting belt 5 of the present example has a shape in which a plurality of grooves are formed along the circumferential direction of the transporting belt 5, namely along the transport direction A. In other words, recesses and protrusions formed in the contact surface 5*b* of the transporting belt 5 of the present example are formed by circumferential grooves extending along the circumferential direction of the transporting belt 5, which serve as the recessed portions 52, and by each of regions serving as the protruding portions 51 sandwiched between the circumferential grooves forming the recessed portions 52. By forming the recessed portions 52 using the circumferential grooves extending along the circumferential direction of the transporting belt 5 in such a manner, a contact state of the contact surface 5*b* with the driven roller 3 and driving roller 4 can always be kept constant, and it is thus possible to suppress the deterioration in the transport accuracy caused by variations in the contact state of the contact surface 5*b* with the driven roller 3 and driving roller 4.

Note that, in a similar manner to the recesses and protrusions formed at the contact surface 5*b* of the transporting belt 5, the recesses and protrusions formed on the contacted surface of the driven roller 3 and the contacted surface 4*b* of the driving roller 4 may be formed by the circumferential grooves along the circumferential direction of the driven roller 3 and driving roller 4, which serve as the recessed portions 52, and each of the regions serving as the protruding portions 51 sandwiched between the circumferential grooves forming the recessed portions 52. By forming the recessed portions 52 using the circumferential grooves extending along the circumferential direction of the driven roller 3 and the driving roller 4, a contact state of the contacted surface of the driven roller 3 and the contacted surface 4*b* of the driving roller 4 with the transporting belt 5 can always be kept constant, and it is thus possible to suppress the deterioration in the transport accuracy caused by variations in the contact state of the contacted surface of the driven roller 3 and the contacted surface 4*b* of the driving roller 4 with the transporting belt 5.

Note that the disclosure is not limited to the aforementioned examples, and many variations are possible within the scope of the disclosure as described in the appended claims. It goes without saying that such variations also fall within the scope of the disclosure.

What is claimed is:

1. A liquid ejecting device comprising:

an endless transporting belt stretched over a plurality of rollers and configured to transport a medium in a transport direction by rotating while supporting the medium at a support surface that is a surface on an opposite side from a contact surface with the rollers; and a liquid ejecting unit configured to eject a liquid onto the medium supported by the support surface, wherein:

recesses and protrusions are regularly formed at the contact surface in a circumferential direction of the transporting belt, and the recesses and protrusions include, as recessed portions, a plurality of first direction grooves extending along a first direction that intersects the circumferential direction and a width direction, of the transporting belt, intersecting the circumferential direction, and a plurality of second direction grooves extending along a second direction that intersects all of the circumferential direction, the width direction, and the first direction, and include, as protruding portions, each of regions surrounded by the first direction grooves and the second direction grooves forming the recessed portions.

2. The liquid ejecting device according to claim 1, wherein the recesses and protrusions are formed at the contact surface entirely in the circumferential direction.

3. The liquid ejecting device according to claim 1, wherein a recess/protrusion formation region, in which the recesses and protrusions are formed, and a recess/protrusion non-formation region, in which the recesses and protrusions are not formed, are alternately provided at the contact surface in the circumferential direction.

4. The liquid ejecting device according to claim 1, wherein the recesses and protrusions include a plurality of convex-shaped protruding portions, and regions other than the protruding portions are formed as recessed portions.

5. The liquid ejecting device according to claim 1, wherein the recesses and protrusions include, as recessed portions, circumferential grooves extending along the circumferential direction, and include, as protruding portions, each of regions sandwiched between the circumferential grooves forming the recessed portions.

6. The liquid ejecting device according to claim 1, comprising:

a drying unit configured to dry, from a side of the contact surface, the liquid attached to the contact surface.

7. A liquid ejecting device comprising:

an endless transporting belt stretched over a plurality of rollers and configured to transport a medium in a transport direction by rotating while supporting the medium at a support surface that is a surface on an opposite side from a contact surface with the rollers; and a liquid ejecting unit configured to eject a liquid onto the medium supported by the support surface, wherein:

recesses and protrusions are regularly formed at the contact surface in a circumferential direction of the transporting belt, and the recesses and protrusions include, as protruding portions, a plurality of first direction ridge portions extending along a first direction that intersects the circumferential direction and a width direction, of the transporting belt, intersecting the circumferential direction, and a plurality of second direction ridge portions extending along a second direction intersecting all of the circumferential direction, the width direction, and the first direction, and include, as recessed portions, each of regions surrounded by the first direction ridge portions and the second direction ridge portions forming the protruding portions.

8. A liquid ejecting device comprising:

an endless transporting belt stretched over a plurality of rollers and configured to transport a medium in a transport direction by rotating while supporting the medium at a support surface that is a surface on an opposite side from a contact surface with the rollers; and a liquid ejecting unit configured to eject a liquid onto the medium supported by the support surface, wherein:

recesses and protrusions are regularly formed, in circumferential directions of the respective rollers, on contacted surfaces of the respective rollers that come into contact with the contact surface, the recesses and protrusions include, as recessed portions, a plurality of first direction grooves extending along a first direction that intersects the circumferential direction and a width direction, of the transporting belt, intersecting the circumferential direction, and a plurality of second direction grooves extending along a second direction intersecting all of the circumferential direction, the width direction, and the first direction, and include, as protruding portions, each of regions surrounded by the first direction grooves and the second direction grooves forming the recessed portions.

9. The liquid ejecting device according to claim 8, wherein the recesses and protrusions are formed at the contacted surfaces entirely in the circumferential direction.

10. The liquid ejecting device according to claim 8, wherein a recess/protrusion formation region, in which the recesses and protrusions are formed, and a recess/protrusion non-formation region, in which the recesses and protrusions are not formed, are alternately provided at the contacted surfaces in the circumferential direction.

11. The liquid ejecting device according to claim 8, wherein the recesses and protrusions include a plurality of convex-shaped protruding portions, and regions other than the protruding portions are formed as recessed portions.

12. The liquid ejecting device according to claim 8, wherein the recesses and protrusions include, as recessed portions, circumferential grooves extending along the circumferential direction, and include, as protruding portions, each of regions sandwiched between the circumferential grooves forming the recessed portions.

13. A liquid ejecting device comprising:

an endless transporting belt stretched over a plurality of rollers and configured to transport a medium in a transport direction by rotating while supporting the medium at a support surface that is a surface on an opposite side from a contact surface with the rollers; and a liquid ejecting unit configured to eject a liquid onto the medium supported by the support surface, wherein:

recesses and protrusions are regularly formed, in circumferential directions of the respective rollers, on contacted surfaces of the respective rollers that come into contact with the contact surface, and the recesses and protrusions include, as protruding portions, a plurality of first direction ridge portions extending along a first direction that intersects the circumferential direction and a width direction, of the transporting belt, intersecting the circumferential direction, and a plurality of second direction ridge portions extending along a second direction intersecting all of the circumferential direction, the width direction, and the first direction, and include, as recessed portions, each of regions surrounded by the first direction ridge portions and the second direction ridge portions forming the protruding portions.

* * * * *